US005569136A

United States Patent [19]

Holten

[11] Patent Number: 5,569,136

[45] Date of Patent: Oct. 29, 1996

[54] PORTABLE FOREARM EXERCISING DEVICE

[76] Inventor: William S. Holten, 1000 Lincoln St., Maryville, Ill. 62062

[21] Appl. No.: 362,840

[22] Filed: Dec. 22, 1994

Related U.S. Application Data

[63] Continuation-in-part of Ser. No. 177,522, Jan. 4, 1994, abandoned.

[51] Int. Cl.[6] ..... A63B 21/055

[52] U.S. Cl. ..... 482/126

[58] Field of Search ..... 482/121–126, 482/129, 130

[56] References Cited

U.S. PATENT DOCUMENTS

| | | | |
|---|---|---|---|
| 2,930,614 | 3/1960 | McIntosh | 482/126 |
| 3,215,429 | 11/1965 | Shaboo et al. | 482/125 |
| 3,655,185 | 4/1972 | Kane | 482/125 |
| 4,023,808 | 5/1977 | Hebert | 482/125 |
| 4,361,324 | 11/1982 | Baroi | 482/123 X |
| 4,733,861 | 3/1988 | Plunkett, III | 482/125 X |

*Primary Examiner*—Richard J. Apley
*Assistant Examiner*—John Mulcahy

[57] ABSTRACT

A portable forearm exercising device for developing and strengthening forearm muscles important to sports activities requiring swinging motion. First and second hand grips are provided. The ends of an elongated elastic band are attached transversely at the ends of each hand grip. The elastic bands are coupled together by a ring which may be loosened or tightened to maintain its position along each resistance element. The user exercises by pulling the hand grips apart against the resistance of the elastic bands.

1 Claim, 8 Drawing Sheets

FIG 5
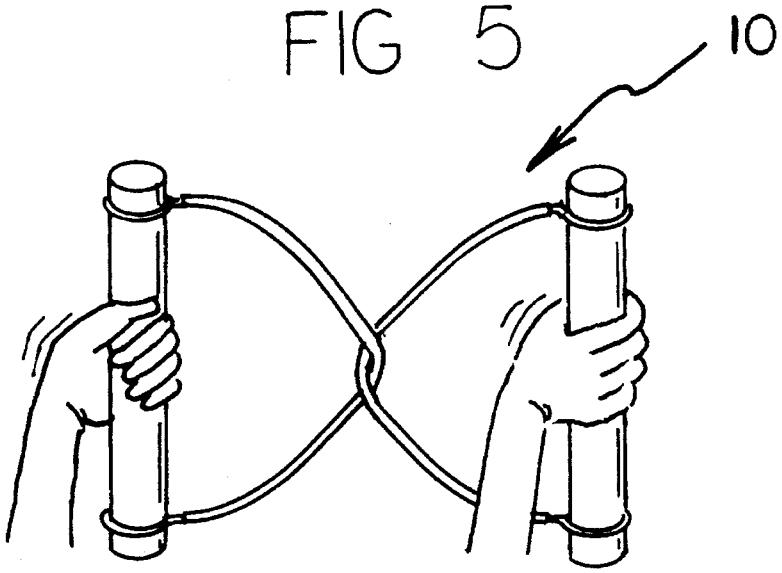
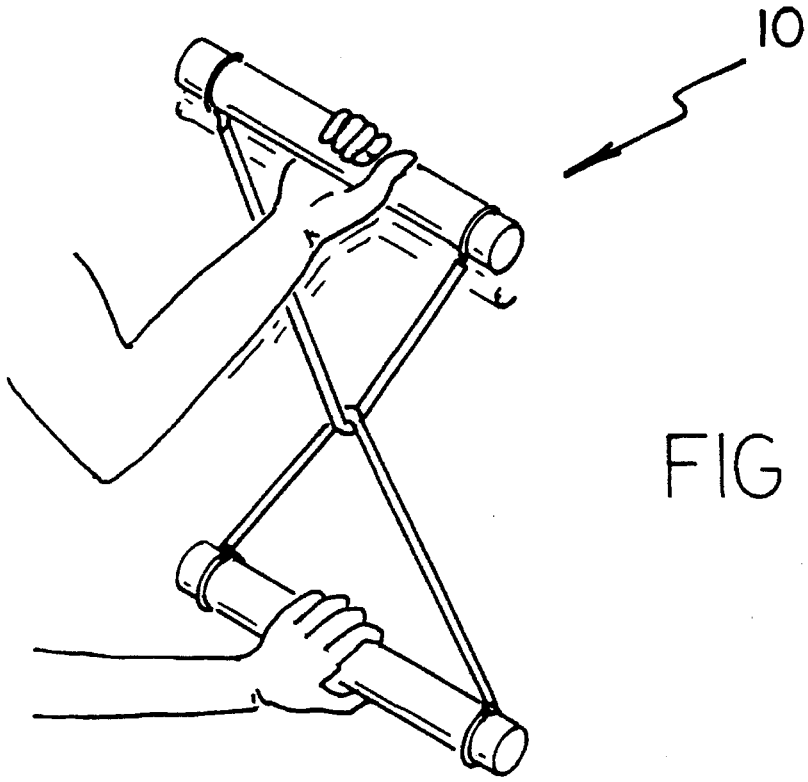
FIG 6

FIG 11
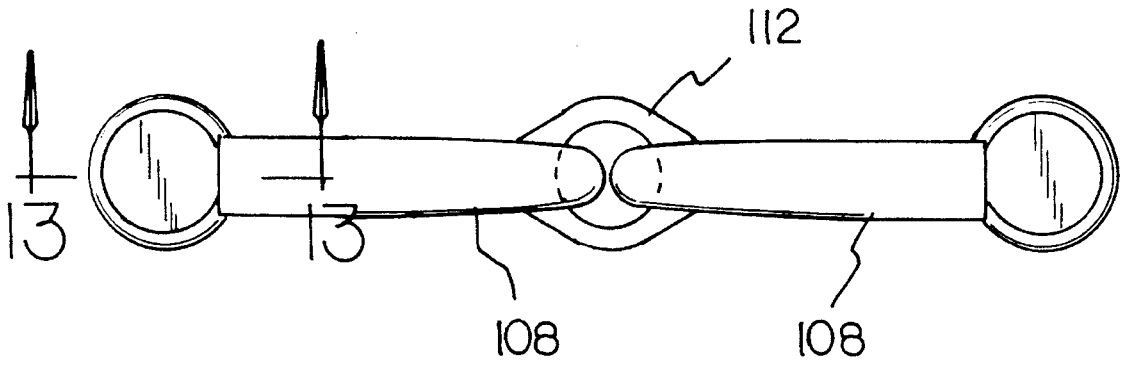
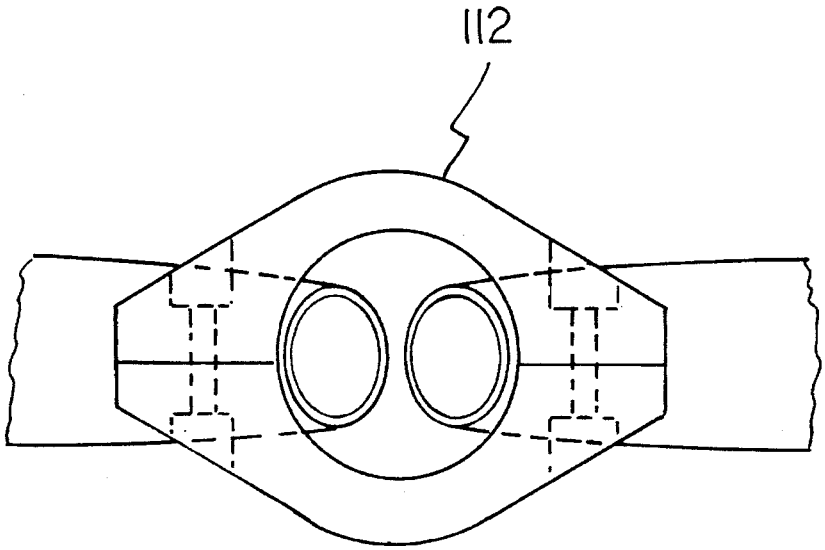
FIG 12

FIG 13
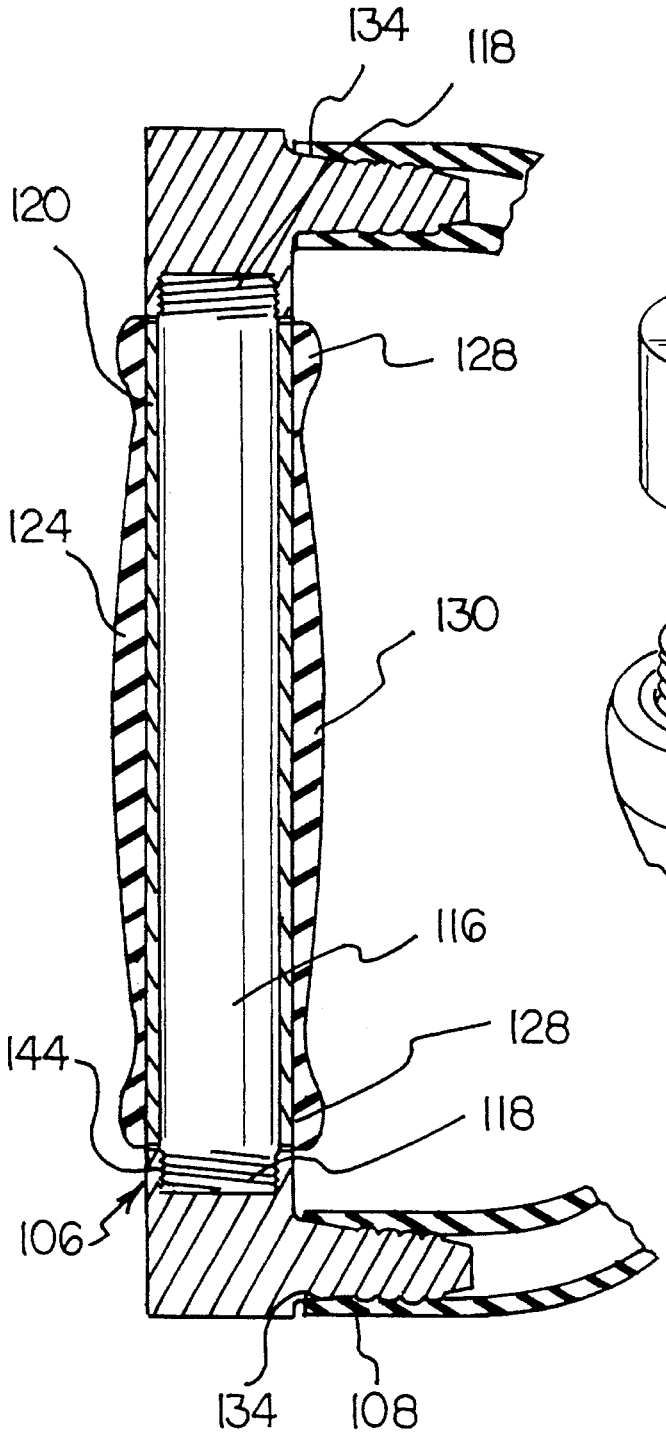
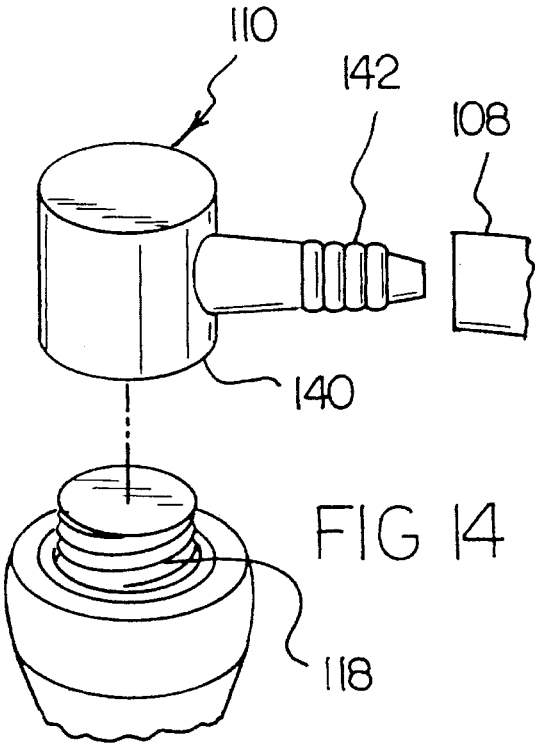
FIG 14

PORTABLE FOREARM EXERCISING DEVICE

BACKGROUND OF THE INVENTION

1. Related Application

The present application is a continuation-in-part application of U.S. patent application Ser. No. 08\177,522 filed Jan. 4, 1994, and now abandoned.

2. Field of the Invention

The present invention relates to exercising devices and more particularly pertains to portable forearm exercising devices which may be adapted for developing and strengthening a group of forearm muscles important to sports activities requiring swinging motion such as baseball, tennis, golf, and the like.

3. Description of the Prior Art

The use of forearm exercising devices is known in the prior art. More specifically, forearm exercising devices heretofore devised and utilized for the purpose of developing and strengthening a group of forearm muscles are known to consist basically of familiar, expected and obvious structural configurations, notwithstanding the myriad of designs encompassed by the crowded prior art which have been developed for the fulfillment of countless objectives and requirements.

The present invention is directed to improving devices for developing and strengthening a group of forearm muscles important to sports activities requiring swinging motion such as baseball, tennis, golf, and the like in a manner which is safe, secure, economical and aesthetically pleasing.

For example, U.S. Pat. No. 3,652,085 to Cole discloses an exercise device for developing and strengthening the arm muscles, particularly those muscles associated with the act of throwing. The apparatus includes spherical hand grip connected to one end of an elastic cord to which structure is provided at the other end for anchoring the apparatus to a relatively immobile object of restraint.

U.S. Pat. No. 4,861,022 to Boatcallie describes an exerciser primarily for chest muscles activated by pushing the handle ends of the device toward one another with the forearms, the hands playing an insignificant role in the use of the exerciser. It consists basically of a pair of levers rotatably secured to each other by a pivot pin joining the two levers near one pair of their ends, and elastic bands biasing the device in an open stance attitude, with the levers spread apart.

While these devices fulfill their respective, particular objectives and requirements, the aforementioned patents do not disclose a portable forearm exercising device for developing and strengthening a group of forearm muscles important to sports activities requiring swinging motion such as baseball, tennis, golf, and the like. Furthermore, neither of these devices are portable or do not require an external immobile object for anchoring.

The prior art also discloses an expander type exercising apparatus as shown in U.S. Pat. No. 5,020,796 to Ullmann which consists of an elongated stretchable elastic element consisting of one or more coil springs, elastic tubes and/or elastic strands. The elastic element is confined in the median portion of an elongated tube-like envelope the end portions of which are directly or indirectly secured to and extend beyond the respective ends of the elastic element. The end portions of the envelope have looped sections which constitute handles to be grasped by a person wishing to stretch the elastic element by way of the two end portions of the envelope. The invention disclosed uses woven filament loops for grasping handles. Handles so constructed will pinch together the user's hands and fingers making the device uncomfortable and difficult to use.

Other patents of interest include U.S. Pat. No. 4,455,019 to Harris which shows an exerciser for finger, hand, wrist and forearm and U.S. Pat. No. 4,392,649 to Chapman which discloses a hand, wrist and forearm exercising device. Both of these devices are complex in design and construction thereby making them costly to manufacture and market. Moreover, neither of the inventions described is portable.

In this respect, the portable forearm exercising device according to the present invention substantially departs from the conventional concepts and designs of the prior art, and in so doing provides an apparatus primarily developed for the purpose of developing and strengthening a group of forearm muscles important to sports activities requiring swinging motion such as baseball, tennis, golf, and the like.

Therefore, it can be appreciated that there exists a continuing need for new and improved portable forearm exercising device which can be used for developing and strengthening a group of forearm muscles important to sports activities requiring swinging motion such as baseball, tennis, golf, and the like. In this regard, the present invention substantially fulfills this need.

As illustrated by the background art, efforts are continuously being made in an attempt to develop devices for developing and strengthening a group of forearm muscles. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of forearm exercising devices now present in the prior art, the present invention provides an improved portable forearm exercising device construction wherein the same can be utilized for developing and strengthening a group of forearm muscles important to sports activities requiring swinging motion such as baseball, tennis, golf, and the like. As such, the general purpose of the present invention, which will be described subsequently in greater detail, is to provide a new and improved portable forearm exercising device apparatus and method which has all the advantages of the prior art portable forearm exercising devices and none of the disadvantages.

To attain this, the present invention essentially comprises a new and improved portable forearm exercising device for developing and strengthening a group of forearm muscles important to sports activities requiring swinging motion such as baseball, tennis, golf, and the like, the portable forearm exercising device comprising, in combination: a first functional assembly being in cooperative interconnected relationship with a second functional assembly, the second functional assembly being identical to the first functional assembly, the first and second functional assemblies each comprising: an elongated hand grip, each hand grip including a shaft formed in a generally cylindrical configuration with two end segments, each end segment having a smaller diameter than the remainder of the shaft and including a plurality of external screw threads, an inner sleeve formed in a hollow generally cylindrical configuration, the sleeve having a slightly larger diameter than the shaft, the sleeve being positioned around the shaft between the end segments, the configuration and positioning of the sleeve permitting circular rotation around the shaft, hand cushioning means being fabricated of a resilient material such as foam rubber and affixed around the sleeve, the hand cushioning means having thick end regions and a thick central region therebetween, the thickness gradually decreasing from the central region to each end region, the hand cushioning means providing the user with increased comfort and control of the hand grip during vigorous manipulation of the device, the hand cushioning means being particularly useful when the user's hands become slippery with perspiration; an elastic resistance element for each hand grip, the resistance element being fabricated of elastic materials and formed in a hollow tubular configuration with two open ends, the resistance element including coupling means adjacent to each open end; attachment devices for coupling the free ends of the resistance elements to each hand grip, each attachment device formed in a generally L-shaped configuration, each attachment device having a large segment and a small segment, each large segment formed in a generally cylindrical configuration with a bore at one end, each bore including a plurality of internal screw threads, each bore adapted to be coupled to the end segments of each shaft, the small segment of each attachment device being formed in a generally cylindrical configuration with coupling means affixed thereto, each small segment adapted to be positioned within the coupling means of the open ends of the resistance elements, the fully constructed functional assemblies each being shaped in a generally semi circular configuration; and a coupling ring formed in a generally circular configuration, the ring comprising two identical generally semi circular shaped portions, each portion having two end regions and a rounded middle region therebetween, each end region having a circular aperture extending therethrough, the portions being coupled together with nuts and bolts through their aligned apertures, the ring being positioned around the approximate center point of each elastic resistance element, the ring coupling the functional assemblies together during operation and use such that a user may grasp the hand grip of the first functional assembly with one hand while simultaneously grasping the hand grip of the second functional assembly with the other hand, the user thereby obtaining a repeatable amount of resistance to specific muscle activity, the specific muscles exercised being determined by an exercise routine.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide an portable forearm exercising device for developing and strengthening a group of forearm muscles important to sports activities requiring swinging motion such as baseball, tennis, golf, and the like.

It is therefore an additional object of the present invention to provide a new and improved portable forearm exercising device which has all the advantages of the prior art portable forearm exercising devices and none of the disadvantages.

It is another object of the present invention to provide a new and improved portable forearm exercising device which may be easily and efficiently manufactured and marketed.

It is a further object of the present invention to provide a new and improved portable forearm exercising device which is of a durable and reliable construction.

An even further object of the present invention is to provide a new and improved portable forearm exercising device which is susceptible of a low cost of manufacture with regard to both materials and labor, and which accordingly is then susceptible of low prices of sale to the consuming public, thereby making such portable forearm exercising devices economically available to the buying public.

Still yet another object of the present invention is to provide a new and improved portable forearm exercising device which provides in the apparatuses and methods of the prior art some of the advantages thereof, while simultaneously overcoming some of the disadvantages normally associated therewith.

Still yet another object of the present invention is to provide a new and improved portable forearm exercising device which is compact and light weight thereby being convenient to transport.

Yet another object of the present invention is to provide a new and improved portable forearm exercising device which is designed and constructed to be easy to grip without pinching the user's hands or fingers.

Even still another object of the present invention is to provide a new and improved portable forearm exercising device which does not require connection to any external apparatus or support.

Lastly, it is an object of the present invention to provide a new and improved portable forearm exercising device for developing and strengthening a group of forearm muscles important to sports activities requiring swinging motion such as baseball, tennis, golf, and the like, the portable forearm exercising device comprising: hand grip means comprising a first and a second identical rigid elongated generally cylindrical member with two ends; resistance means comprising a first and a second identical elongated elastic band with two ends; the first resistance means being coupled at each end to the ends of the first hand grip means; the second resistance means being coupled at each end to the ends of the second hand grip means; and the first and second resistance means being operatively coupled such that a user may grasp the first hand grip means with one hand while simultaneously grasping the second hand grip means with the other hand for employing the resistance means in the performance of an exercise routine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective view of the invention of FIG. 1 showing its manner of use.

FIG. 6 is a perspective view of the invention of FIG. 1 showing an alternate manner of use.

FIG. 11 is a top plan view of the apparatus shown in FIG. 9.

FIG. 12 is an enlarged cross sectional view of the coupling ring of the apparatus shown in FIG. 11.

FIG. 13 is a cross sectional view of the shaft of the apparatus shown in FIG. 11.

FIG. 14 a broken away perspective view of the attachment device of the apparatus shown in FIG. 9.

DESCRIPTION OF THE PREFERRED EMBODIMENT

Figure 1:
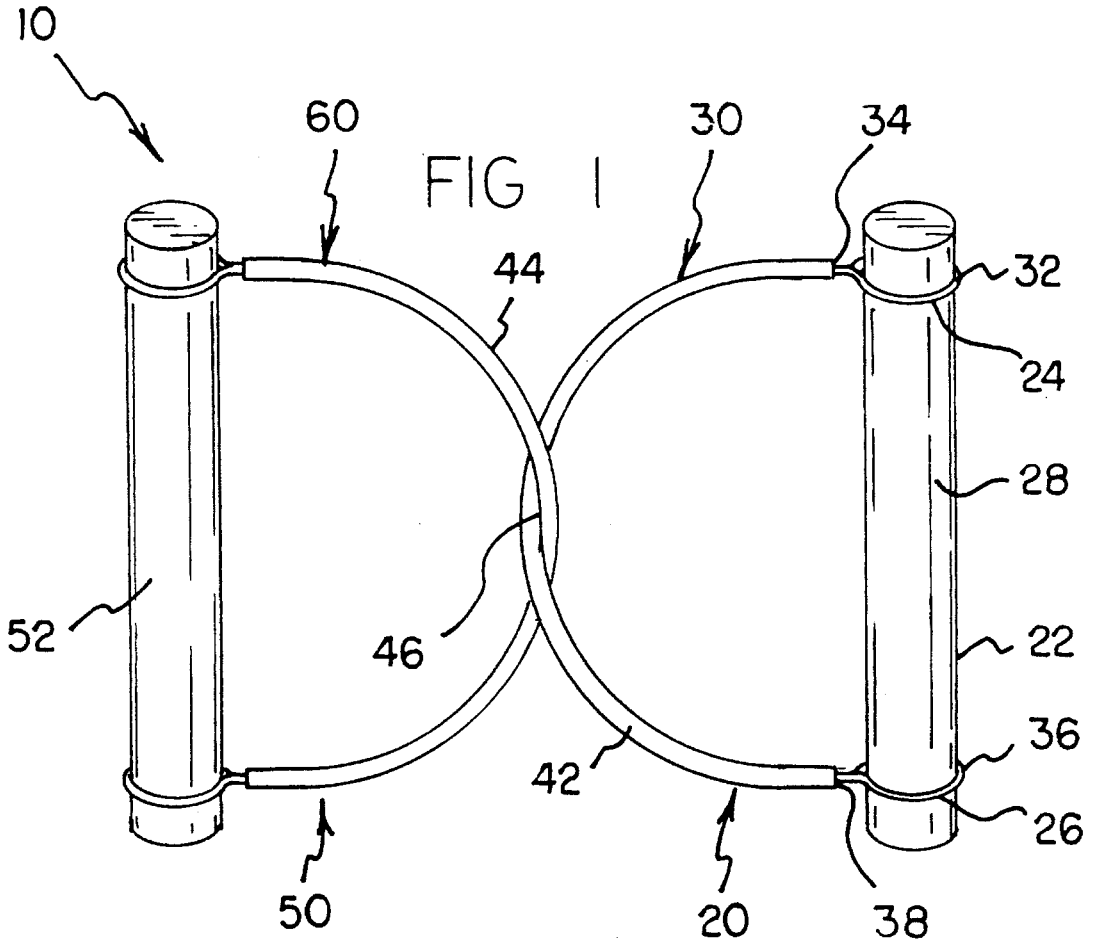
FIG. 1 is a perspective view of an embodiment of the present invention portable forearm exercising device.
Figure 2:
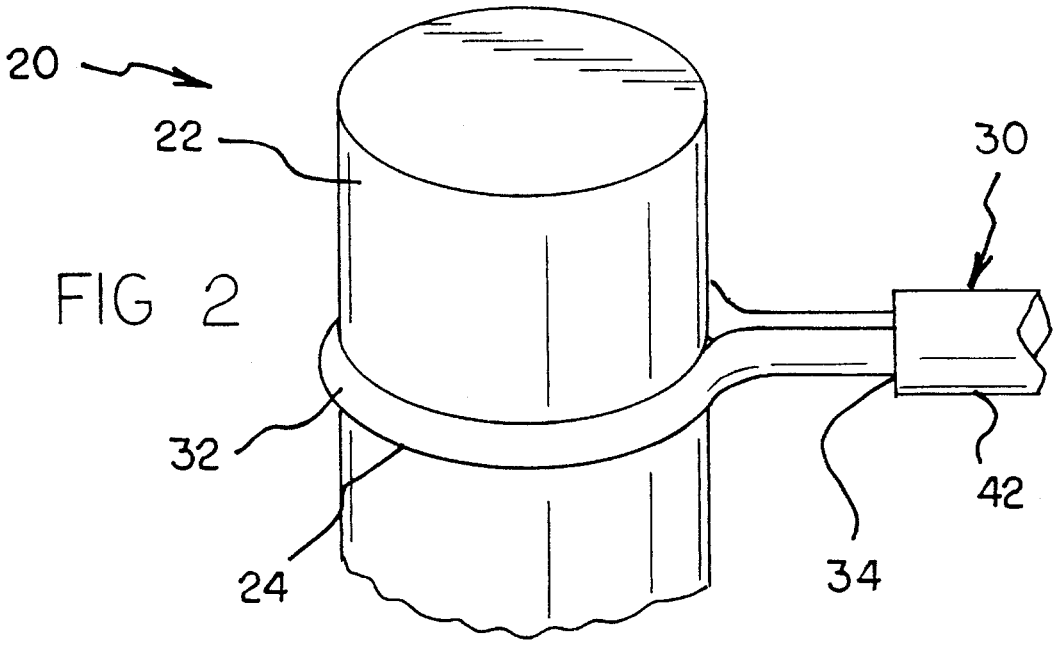
FIG. 2 is a detailed view of the invention of FIG. 1 showing the manner of connection of an elastic resistance element to a hand grip.
Figure 3:
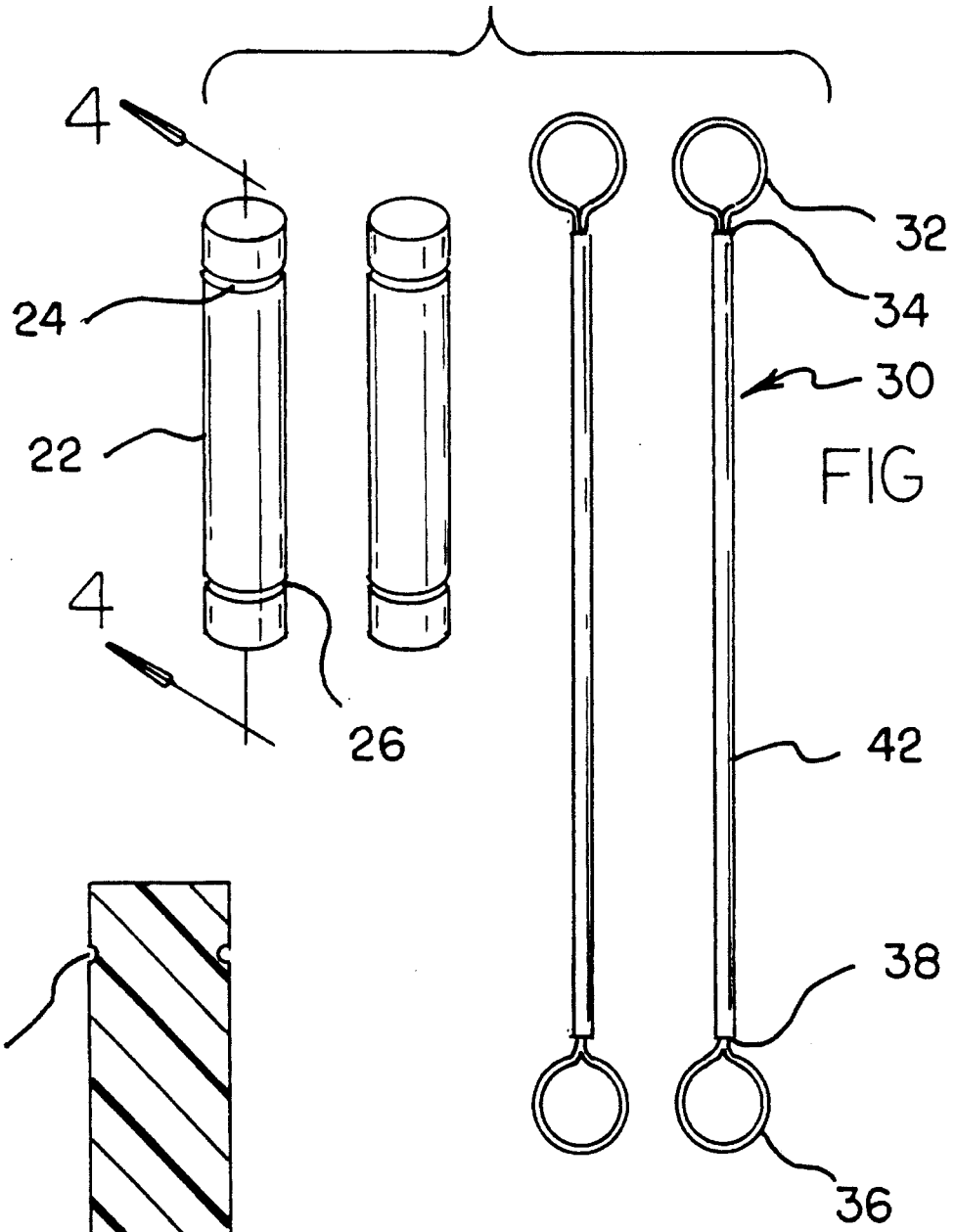
FIG. 3 is a perspective view of the components making up the invention of FIG. 1.
Figure 4:
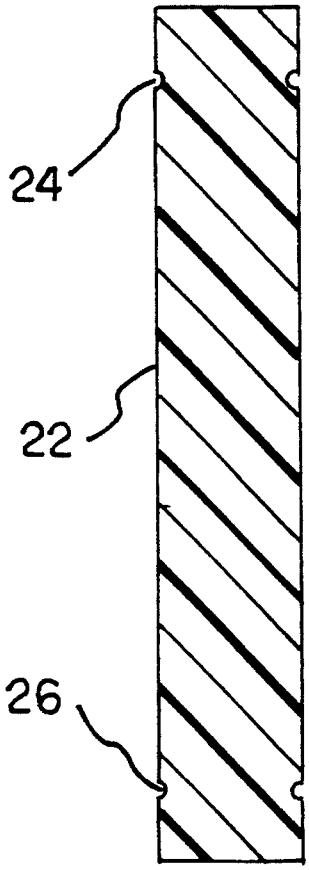
FIG. 4 is a sectional view of a hand grip of the invention of FIG. 3 taken along the line 4—4.
Figure 9:
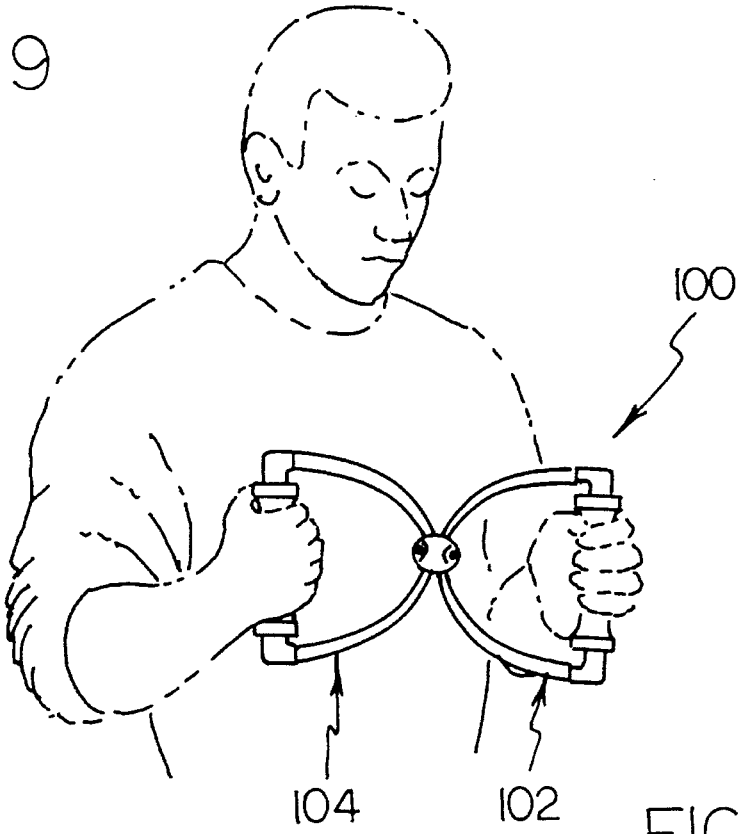
FIG. 9 is a perspective view of another embodiment of the portable forearm exercising device constructed in accordance with the principles of the present invention.

With reference now to the drawings, and in particular to FIGS. 1 and 9 thereof, a new and improved portable forearm exercising device embodying the principles and concepts of the present invention and generally designated by the reference numerals 10 and 100 will be described.

From an overview standpoint, the portable forearm exercising device is adapted for use for developing and strengthening a group of forearm muscles important to sports activities requiring swinging motion such as baseball, tennis, golf, and the like. See FIGS. 1 and 9.

An embodiment of the apparatus is shown in FIGS. 1 through 6. More specifically, it will be noted that a portable forearm exercising device 10 for developing and strengthening a group of forearm muscles important to sports activities requiring swinging motion such as baseball, tennis, golf, and the like is shown. The portable forearm exercising device 10 comprises a first functional assembly 20 being in cooperative interconnected relationship with a second functional assembly 50, the second functional assembly 50 being identical to the first functional assembly 20.

The first functional assembly 20 comprises an elongated elastic resistance element 30 fixedly connected on both ends to a generally cylindrical hand grip 22. Each end of the resistance element has a non-elastic loop 32 and 36, formed of metal or the like, fixedly longitudinally projecting therefrom. The loops 32 and 36 tightly engage with annular grooves 24 and 26 formed in opposing ends of the hand grip 22. The resistance element 30 is thus fixedly connected to opposing ends of the hand grip while also providing a gripping area 28 therebetween. The cylindrical hand grip 22 is formed of rigid hard material such as plastic or wood.

The portable forearm exercising device 10 also includes the elastic element 30 of the first functional assembly 20 being operatively looped through the elastic element 60 of the second functional assembly 50. Such an interconnection 46 allows a user to grasp the hand grip 22 of the first functional assembly with one hand while simultaneously grasping the hand grip 52 of the second functional assembly with the other hand to obtain a repeatable amount of resistance to specific muscle activity, the specific muscles exercised being determined by an exercise routine.

FIGS. 5 and 6 illustrate two of many methods of use of the portable forearm exercise device 10.

Figure 7:
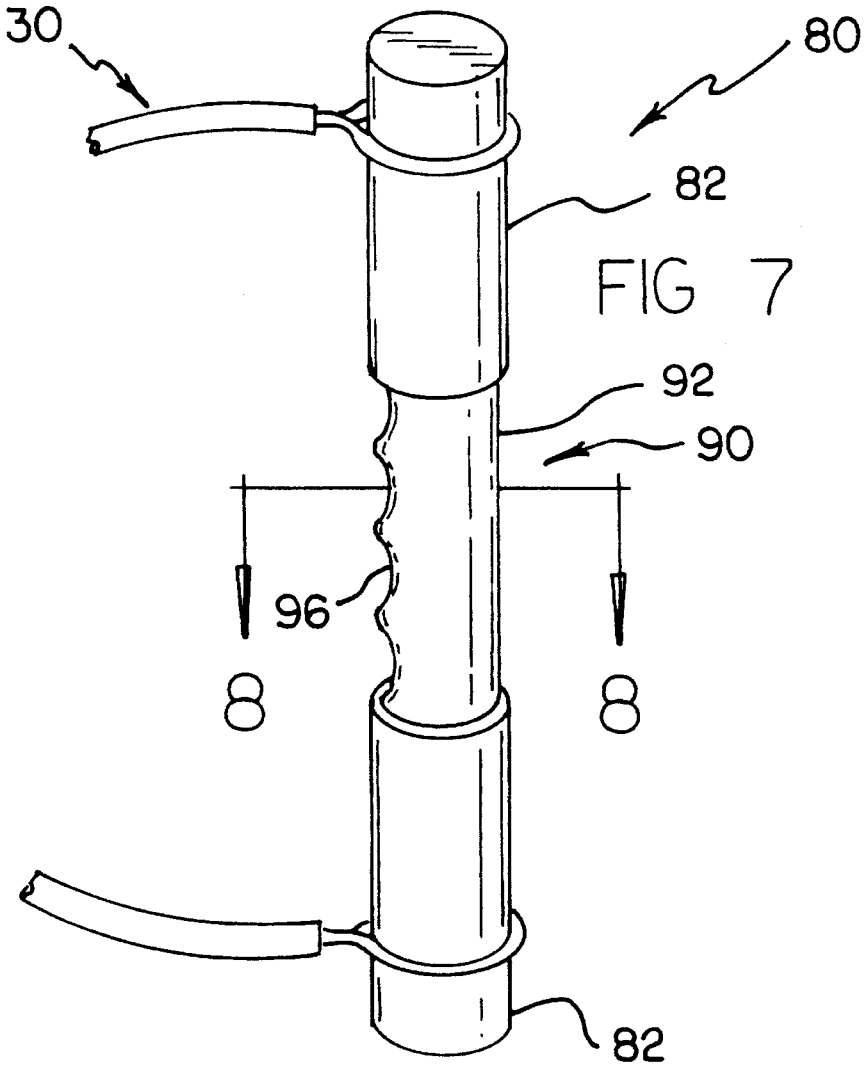
FIG. 7 is a partial perspective view of the present invention illustrating an alternate embodiment which includes a cushioned hand grip with finger notches.
Figure 8:
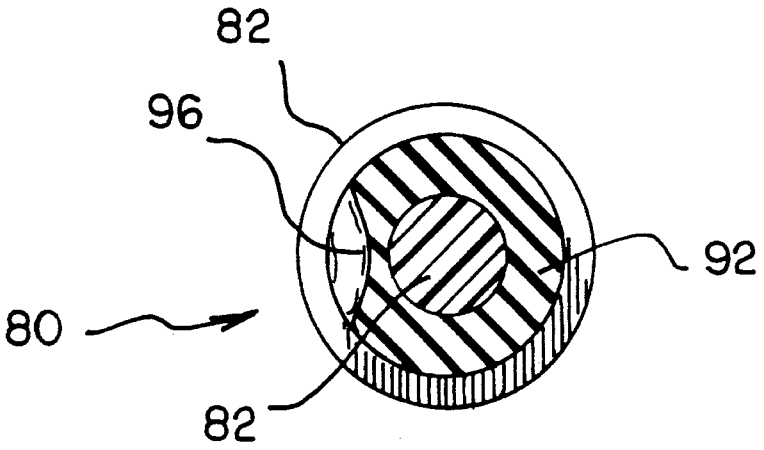
FIG. 8 is a sectional view of the invention of FIG. 7 taken along the line 8—8.

An alternate embodiment of the portable forearm exercising device, and generally designated by the reference numeral 80, is shown in FIGS. 7 and 8. The cylindrical hand grip 82 further includes hand cushioning means 90. The cushioning means 90 is formed of resilient material, such as foam rubber, disposed around the gripping area 92 whereby providing the user with increased comfort.

The hand cushioning means 90 may additionally include finger notches 96 formed thereon whereby providing the user with improved control of the hand grip 82 during vigorous manipulation of the device 10 and/or if the hand grip 82 becomes slippery with perspiration.

Figure 10:
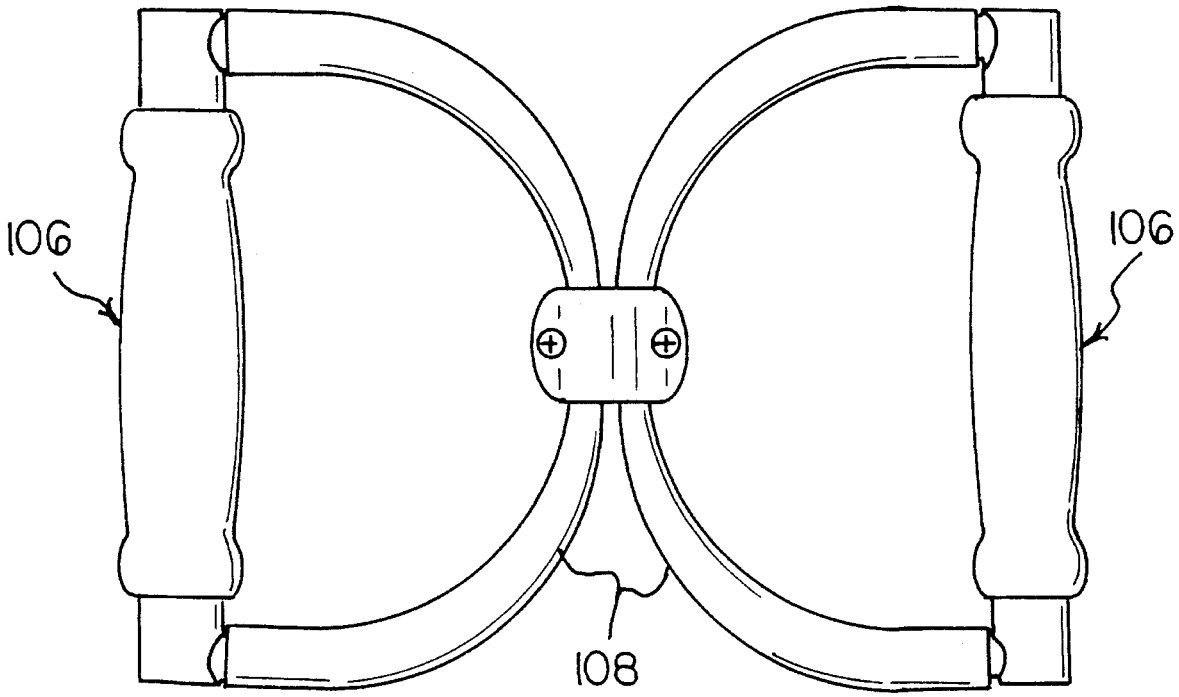
FIG. 10 is a front perspective view of the apparatus shown in FIG. 9.

In another embodiment of the present invention, the portable forearm exercising device is comprised of a plurality of components. Such components in their broadest context include a first functional assembly 102, a second functional assembly 104, two elongated hand grips 106, two resistance elements 108, four attachment devices 110 and a coupling ring 112. Note FIG. 10.

A first functional assembly 102 is in cooperative interconnected relationship with a second functional assembly 104. The second functional assembly is identical to the first functional assembly. The first and second functional assemblies each comprise a hand grip, a resistance element and two attachment devices. The functional assemblies are coupled together with a coupling ring. Note FIGS. 10 and 12.

Each elongated hand grip 106 includes a shaft 116 formed in a generally cylindrical configuration with two end segments 118. The cylindrical hand grip is formed of rigid hard material such as plastic or wood. Note FIG. 13. Each end segment 118 has a smaller diameter than the remainder of the shaft and includes a plurality of external screw threads. The end segments are adapted to be releasably coupled to the attachment devices. The releasably coupled orientation permits the user to easily assemble and disassemble the apparatus when desired. An inner sleeve 120 is formed in a hollow, generally cylindrical configuration. The sleeve has a slightly larger diameter than the shaft. The sleeve is positioned around the shaft between the end segments. The configuration and positioning of the sleeve permits circular rotation around the shaft. This configuration permits the user to manipulate the apparatus in a plurality of different orientations. Note FIGS. 13 and 14.

Hand cushioning means 124 are fabricated of a resilient material such as foam rubber. The hand cushioning means are securely affixed around the sleeve 120. The hand cushioning means have thick end regions 128 and a thick central region 130 therebetween. The thickness gradually decreases from the central region to each end region. The hand cushioning means provide the user with increased comfort and control of the hand grip during vigorous manipulation of the device. The hand cushioning means are particularly useful when the user's hands become slippery with perspiration. The thick central region of the hand cushioning means provides support to the user's hand where it is most needed. Note FIGS. 13, 15 and 16.

An elastic resistance element 108 is coupled to each hand grip 106. The resistance element is fabricated of elastic materials and formed in a hollow tubular configuration with two open ends 134. Rubber and other elastomeric materials make ideal resistance elements. The resistance element includes coupling means adjacent to each open end. The resistance elements are coupled to the hand grips by way of four attachment devices. Note FIGS. 9, 13 and 14.

Four attachment devices 110 are utilized to couple the free ends of the resistance elements to each hand grip. Each attachment device is formed in a generally L-shaped configuration. Each attachment device has a large segment 140 and a small segment 142. Each large segment is formed in a generally cylindrical configuration with a bore 144 at one end. Each bore includes a plurality of internal screw threads. Each bore is adapted to be coupled to the end segments of each shaft. This configuration permits the user to easily assemble and disassemble the apparatus when desired. Note FIGS. 13 and 14.

The small segment 142 of each attachment device is formed in a generally cylindrical configuration with generally discoid shaped coupling means affixed to it. Each small segment is adapted to be positioned within the coupling means of the open ends of the resistance elements. The coupling means may be manufactured in an adjustable configuration. This would permit the user to effectively adjust the length of the resistance elements to perform a greater variety of exercises. The fully constructed functional assemblies are each shaped in a generally semi circular configuration. Note FIGS. 14–16.

A coupling ring 112 is formed in a generally circular configuration. The ring comprises two identical, generally semi circular shaped portions. Each portion has two end regions and a rounded middle region therebetween. Each end region has a circular aperture extending through it. The portions are coupled together with nuts and bolts through their aligned apertures. The ring is positioned around the approximate center point of each elastic resistance element. The nuts and bolts permit the user to loosen or tighten the ring to ensure that the ring remains positioned at the approximate center point of each resistance element. Central positioning of the ring is important to the even distribution of tension forces throughout the apparatus and eventually to the muscles of the user. Note FIGS. 11 and 12.

Figure 15:
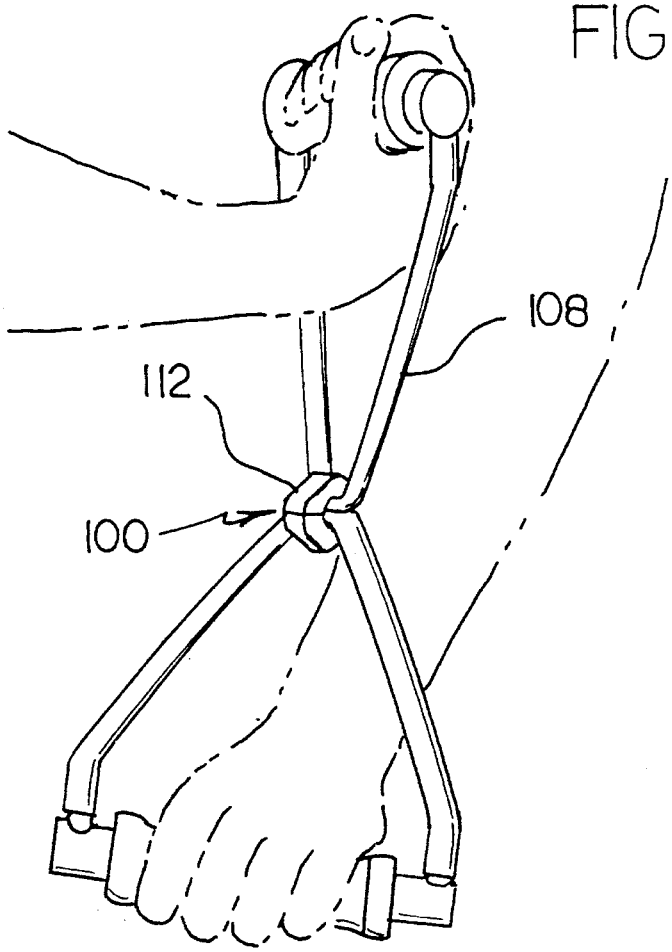
FIG. 15 is a perspective view of the apparatus while being used to perform a curl exercise.
Figure 16:
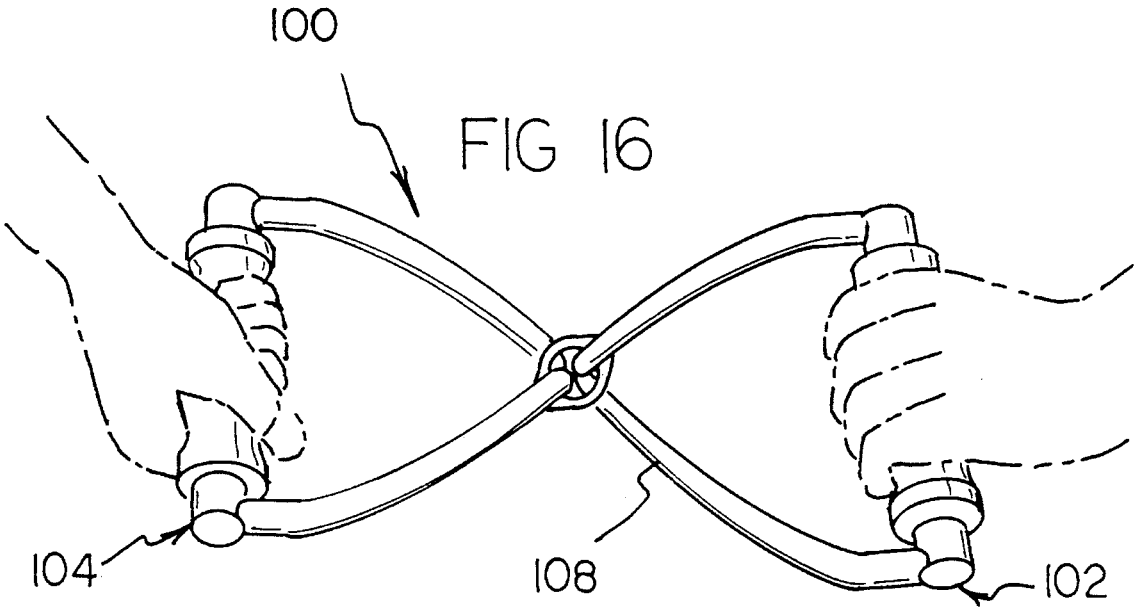
FIG. 16 is a perspective view of the apparatus while being used to perform a twisting exercise.

The ring 112 couples the functional assemblies together during operation and use such that a user may grasp the hand grip of the first functional assembly with one hand while simultaneously grasping the hand grip of the second functional assembly with the other hand. The user thereby obtains a repeatable amount of resistance to specific muscle activity. The specific muscles to be exercised are determined by a predetermined exercise routine. Note FIGS. 9, 11, 15 and 16. FIGS. 15 and 16 illustrate two of many methods of use of this embodiment of the portable forearm exercise device 100. Many other exercise routines may be developed using this versatile device.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

I claim:

1. A new and improved portable forearm exercising device for developing and strengthening a group of forearm muscles important to sports activities requiring swinging motion such as baseball, tennis, golf, and the like, the portable forearm exercising device comprising, in combination:

a first functional assembly being in cooperative interconnected relationship with a second functional assembly, the second functional assembly being identical to the first functional assembly, the first and second functional assemblies each comprising:

an elongated hand grip, each hand grip including a shaft formed in a generally cylindrical configuration with two end segments, each end segment having a smaller diameter than the remainder of the shaft and including a plurality of external screw threads, an inner sleeve formed in a hollow generally cylindrical configuration, the sleeve having a slightly larger diameter than the shaft, the sleeve being positioned around the shaft between the end segments, the configuration and positioning of the sleeve permitting circular rotation around the shaft, hand cushioning means being fabricated of a resilient material and affixed around the sleeve, the hand cushioning means having thick end regions and a thick central region therebetween, the thickness gradually decreasing from the region to each end region, the hand cushioning means providing the user with increased comfort and control of the hand grip during vigorous manipulation of the device particularly when the user's hands become slippery with perspiration;

an elastic resistance element for each hand grip, the resistance element being fabricated of an elastic material and formed in a hollow tubular configuration with two open ends, the resistance element including coupling means adjacent to each open end;

an attachment device for coupling the free ends of each attachment device having a large segment and a small segment extending generally transverse the large segment; the large segment formed in a generally cylindrical configuration with a bore at one end, the bore including a plurality of internal screw threads, the bore adapted to be coupled to the end segments of each shaft such that the small segment of each attachment device extends generally transverse the length of the hand grip, the small segment of the attachment device being formed in a generally cylindrical configuration with generally discoid shaped coupling means affixed thereto, the small segment adapted to be positioned within the coupling means of the open ends of each resistance element; and a coupling ring formed in a generally circular configuration, the ring comprising two identical generally semi circular shaped portions, each portion having two end regions and a rounded middle region therebetween, the end regions each having a circular aperture extending therethrough, the portions being coupled together with nuts and bolts through their aligned apertures whereby the user may loosen or tighten the ring to ensure that the ring remains in position along each resistance element, the ring being positioned around the approximate center point of each elastic resistance element thereby coupling them together, the ring coupling the functional assemblies together during operation and use such that a user may grasp the hand grip of the first functional assembly with one hand while simultaneously grasping the hand grip of the second functional assembly with the other hand, the user thereby obtaining a repeatable amount of resistance to specific muscle activity, the specific muscles exercised being determined by an exercise routine.

* * * * *